United States Patent [19]

Bennett et al.

[11] 4,049,400

[45] Sept. 20, 1977

[54] AIR PURIFYING APPARATUS

[76] Inventors: R. Jackson Bennett, 807 Garber Road, North Muskegon, Mich. 49445; Daniel F. Connors, 25 E. Broadway, Muskegon Heights, Mich. 49441

[21] Appl. No.: 674,368

[22] Filed: Apr. 7, 1976

[51] Int. Cl.[2] ..... B03C 3/08

[52] U.S. Cl. ..... 55/139; 55/143; 55/146; 55/155; 21/74 A; 21/102 R; 250/532

[58] Field of Search ..... 55/139, 140, 141, 143, 55/146, 150, 155, 156, 157, 149; 250/532; 21/74 R, 74 A, 102 R

[56] References Cited

U.S. PATENT DOCUMENTS

| | | | |
|---|---|---|---|
| 512,265 | 1/1894 | Andreoli | 55/155 |
| 871,652 | 11/1907 | Ward | 55/155 |
| 2,488,712 | 11/1949 | Dahlman | 55/143 |
| 2,617,973 | 11/1952 | Wolf, Jr. et al. | 55/139 |
| 2,873,000 | 2/1959 | Elam | 55/139 |
| 3,788,041 | 1/1974 | Gaylord | 55/143 |
| 3,802,159 | 4/1974 | Ferdelman | 55/139 |

FOREIGN PATENT DOCUMENTS

| | | | |
|---|---|---|---|
| 1,265,725 | 3/1972 | United Kingdom | 250/532 |

*Primary Examiner*—Frank W. Lutter
*Assistant Examiner*—David L. Lacey
*Attorney, Agent, or Firm*—Price, Heneveld, Huizenga & Cooper

[57] ABSTRACT

This specification discloses an air purifying apparatus having an ozone generator and an electrostatic filter. The air purifier includes two charge carrying plates abutting opposite sides of a planar dielectric layer along the entire width of each plate, one of the plates being relatively narrow in width in comparison to the other plate. The plate configuration prolongs the life of the dielectric layer and permits easy cleaning of the air purifier.

13 Claims, 5 Drawing Figures

AIR PURIFYING APPARATUS

BACKGROUND OF THE INVENTION

This invention relates to air purifying apparatus; and, more particularly, to air purifying apparatus having an electrostatic filter and ozone generator.

The prior art teaches air purifying apparatus having two electrodes with an intervening dielectric layer for producing a corona to ionize air thus producing ozone as well as acting as an electrostatic filter. The shape of the electrodes has often included a plurality of pin-like protrusions or an interwoven mesh. Such structures have been difficult to clean and produce undesirably high concentrations of electric field on the dielectric layer thereby causing a burn out of the dielectric layer and subsequent shorting of one electrode to the other electrode. Shorting is undesirable because it can damage the air purifying apparatus thereby creating a need for repair work which is both costly and time consuming. Easy cleaning is very important in a device which attracts particle impurities in the air because, periodically, all the partical impurities attracted to the electrodes must, of course, be removed. Difficult cleaning tends to lead to longer intervals between cleaning thus reducing the efficiency of the air purifier.

SUMMARY OF THE INVENTION

An air purifying apparatus in accordance with this invention has two substantially planar electrodes carrying electrical charges of opposite polarity butting against opposite sides of a common dielectric layer. The planar surfaces of the electrodes are either substantially parallel or perpendicular to the dielectric layer thus avoiding an undesirable concentration or electric field on the dielectric layer which prolongs the life of the dielectric layer and prevents shorting of the two electrodes.

In the preferred embodiment, each electrode is sufficiently spaced from the such electrodes to provide for easy cleaning. Air flow passing the electrodes can generally follow the planar sides of the electrodes. Therefore, access to the electrodes for cleaning can follow the path of the air and can be readily accomplished by various cleaning apparatus because of the flat and spaced sides of the electrodes.

DETAILED DESCRIPTION

Figure 1:
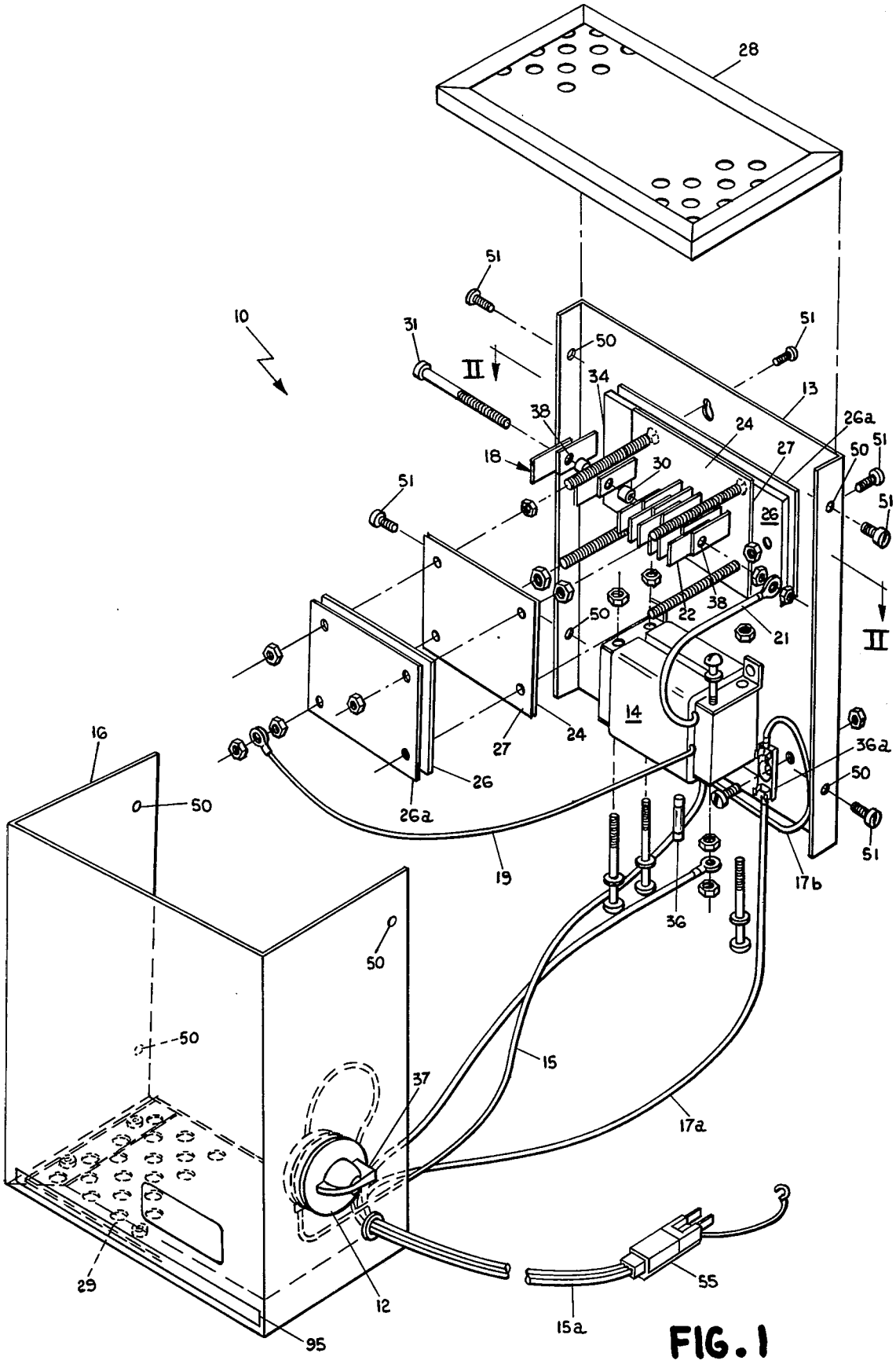
FIG. 1 is an exploded perspective view of an air purifying apparatus in accordance with an embodiment of this invention.

Referring to the drawings, an air purifier 10 as an exterior cover comprising a housing top 28 having perforations for passing air, a housing bottom 29 also having perforations for passing air, a cover 16 for shielding interior components and a housing base 13 for supporting a plurality of interior components. Mounted to housing base 13 are a transformer 14, a fuse 36 retained by a clip-type fuse holder **36*a*, and an electrostatic grid assembly 18** for producing an electrostatic charge to remove impurity particles from the air and for producing an electric field having a sufficient voltage gradient for producing a corona to produce ozone.

Figure 5:
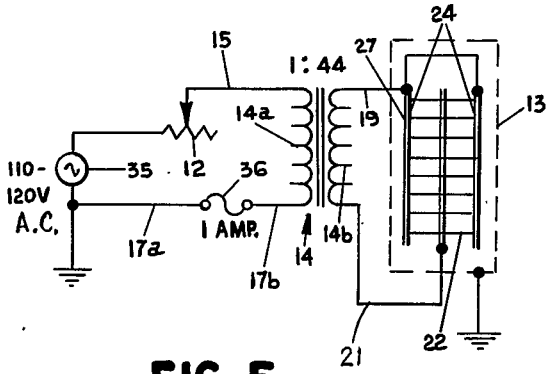
FIG. 5 is a schematic electrical circuit diagram of an air purifying apparatus in accordance with an embodiment of this invention.

Referring particularly to FIG. 5 with FIG. 1, an electrical schematic drawing of air purifier 10 includes a alternating current voltage source 35 coupled through a potentiometer 12, fuse 36, and wires 15, **17*a* and 17*b* to the primary winding 14*a* of transformer 14. The secondary winding of transformer 14 has one terminal coupled by wire 19 to inside backing plates 27 and another terminal coupled by wire 21 to central plates 22 so plates 22 and 27 carry charges of opposite electrical polarity. The two plates 27 are electrically connected by metallic securing bolts 34 as will be described hereinafter. Between plates 22 and 27 are insulating mica sheets 24 and surrounding plates 22 and 27 is housing base 13, indicated as a dotted line in FIG. 5 and grounded for safety. Plates 27 are electrically insulated from housing 13 by planar sheets of dielectric insulation material 26, 26*a*. Potentiometer 12, mounted on cover 16, is electrically coupled to voltage source 35 through an electric plug 55 and a grounded, 3-wire line cord 15*a*, located outside cover 16, and includes a knob 37 on the outside of cover 16 for varying the resistance of potentiometer 12**.

Grid assembly 18 includes a grid central portion 20 which is preferably negatively charged and includes a plurality of planar, parallel, spaced conductive central plates 22. Central plates 22 are rectangular and have major side surfaces 32 and first extremities having end surfaces 33, and second extremities having apertures 38. Surfaces 33 are generally perpendicular to side surfaces 32 and to the top and bottom edges of plates 22. Central plates 22 are mounted by an electrically conductive core pin 31, typically a nut and bolt combination, passing through apertures 38 and are oriented so alternate plates 22 extend in radially opposed directions from core pin 31. End surfaces 33 of central plates 22 extending in a common direction from core pin 31 are oriented along a common plane and firmly contact dielectric sheets or layers 24. Core pin 31 is conductively connected to central plates 22 and the negative terminal of transformer 14 by wire 21. Between each pair of adjacent central plates 22 extending in opposite directions is a spacer 30 for separating the central plates from one another. Spacer 30 has a cylindrical shape with a longitudinal central opening for passing core pin 31 and planar ends for butting against central plates 22. This spacing is advantageous for providing access to central plates 22 for cleaning and for providing a space for corona discharge. The orientation of central plate side surfaces 32 is parallel to the path of a direct flow of air between the perforations in housing bottom 29 and housing top 28. A typical grid central portion 20 has, for example, 14 central plates 22 in seven double plate groupings. A larger capacity air purifier 10 can have more central plates 22.

Figure 2:
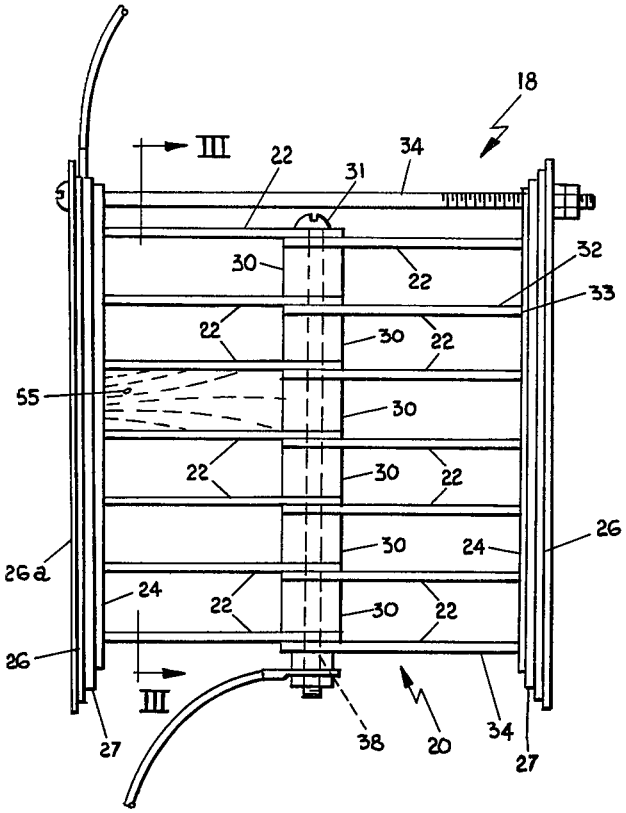
FIG. 2 is a cross sectional view along section line II—II of FIG. 1 of an air purifying apparatus in accordance with the embodiment of this invention.
Figure 3:
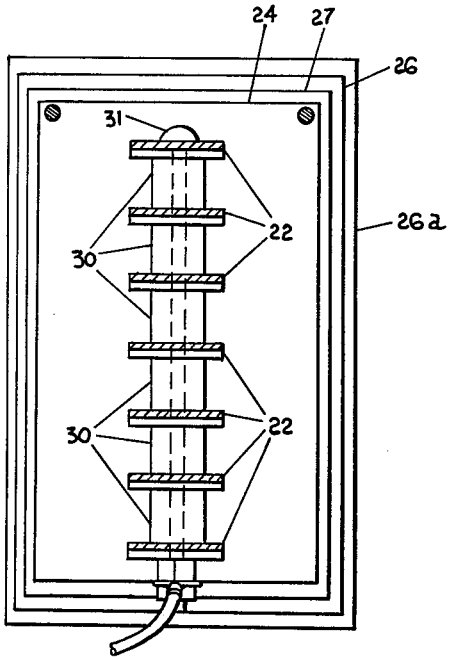
FIG. 3 is a cross sectional view along section line III—III of FIG. 2 of an air purifying apparatus in accordance with an embodiment of this invention.
Figure 4:
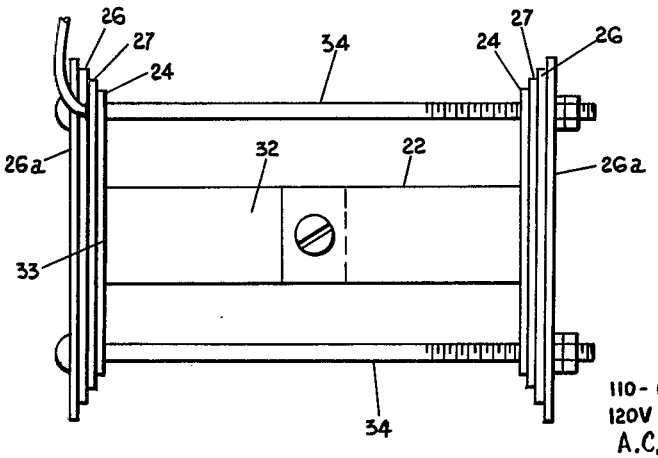
FIG. 4 is a partial interior end view of the air purifying apparatus shown in FIGS. 2 and 3.

Abutting central plate end surfaces 33 are planar, rectangular mica sheets 24, one mica sheet being positioned on either side of core pin 31 generally perpendicular to central plates 22. Preferably, mica sheets 24 each have a thickness in the range of about 0.004°-0.005 inches. A double or greater thickness of mica sheeting may be used on either side of core pin 31, if desired, for a total thickness of about 0.012–0.014 inches. Backing plates 27 about mica sheets 24 on the other side of mica sheets 24 from central plates 22 and are conductively connected to the positive terminal of transformer 14 by wire 19 to carry a positive charge. Plates 27 each have a substantially planar and rectangular shape with mounting openings at each of their four corners. Accordingly, the two conductive electrodes, central plates 22 and backing plates 27, are separated from one another by an intermediate insulating layer mica sheets 24. An electrically conductive, connecting screw 34 passes through the corresponding corner openings of each of backing plates 27 to connect those plates to each other and to compress mica sheets 24 and central plates 22 therebetween. Electrical connection between backing plates 27 may also be accomplished by a low resistance wire connected between the plates. Connecting screw 34 is typically a metallic bolt with a nut fastener which is tightened snugly and then one or two turns more to produce a tight fit of central plates 22 against mica sheets 24. This compression is advantageous to produce an even pressure on end surfaces 33 and to prevent air gaps which might cause sparking betwen mica sheets 24 and end surfaces 33 of central plates 22 and backing plates 27. Thus, the electric field which ionizes the air surrounding central plates 22 has electric field lines extending from the relatively broad side surfaces 32 thereby avoiding a concentrated electric field, and undesirably high voltage on the portions of mica sheets 24 between adjacent central plates 22 thus preventing their burn out. To show how a concentration of electric fields lines is avoided on mica sheets 24, FIG. 2 shows dotted lines 55 representing electric field lines between adjacent central plates 22. Note that there is a relatively constant density of electric field lines on mica sheet 24 between central plates 22. Additionally, sparking and an undesirably high electric field concentration between end surfaces 33 of central plates 22 and backing plates 27 is avoided because end surfaces 33 are relatively planar and butt against mica sheets 24 without any intervening air space whereby sparking could occur.

Preferably a rectangular insulation backing sheet or layer 26 can be placed adjacent backing plates 27 when mounting of grid assembly 18 to housing base 13. Layer 26 prevents the charge on plates 27 from being transferred to housing 13, 16 and is preferably a plastic material having a dielectric strength of approximately 10,000 volts per each ½ inch of thickness. An additional layer 26*a* of fellon insulation or fiberglass insulation having a thickness of about ⅜ inch may also be used. Alternatively, additional stainless steel backing plates for strength and rigidity of the grid assembly may be used in place of layers 26*a*. If desired, a micro switch (not shown) can be mounted on housing base 13 so air purifier 10 is activated only when cover 16 is in place. This prevents exposure of personnel to the high voltage generated on central plates 22.

In the preferred embodiment, cover 16, housing top 28 and housing base 13 have a plurality of apertures 50 which can be selectively aligned to pass screws 51 thus coupling the housing elements of air purifier 10. Also, if desired, a fan can be used to aid air flow through air purifier 10. Further, if desired, an elongated opening 95 (FIG. 1) can be located along the bottom portion of cover 16 for passing air when air purifier 10 is mounted on a horizontal surface and the perforations of housing bottom 29 are obstructed. Transformer 14 is advantageously an iron core, double coil, isolated transformer in which coils can be replaced. An example of a suitable transformer is a Hyboer transformer, Product No. HT-14581. Replacement of coils is advantageous for easy repair of air purifier 10. A typical transformer 14 has a turns ratio of 1 to 44. Accordingly, a voltage applied between central plates 22 and inside backing plate 27 is in the range of about 3,800 volts to about 5,200 volts depending on the setting of potentiometer 12 and based on a typical line voltage of 110–120 volts. The grid assembly 18 including spacers 30, central plates 22, inside backing plates 27, and core pin 31 are advantageously stainless steel to resist corrosion and oxidation which are very prevalent in an ozone producing apparatus. A typical thickness for central plates 22 and backing plates 27 is about 0.062 inch. Similarly, housing base 13, cover 16, housing top 28 and housng bottom 29 are preferably amodized aluminum to prevent corrosion. An alternative to fuse 36 is the use of a circuit breaker, having, for example, a magnitude of one ampere, with a reset button extending through cover 16. For safety, cover 16 housing top 28 and housing bottom 29 are grounded.

In operation, plug 55 is electrically coupled to voltage source 35 and appropriately grounded. Knob 37 of potentiometer 12 is turned to decrease the resistance, from an initially high resistance setting, thereby increasing the charge on central plates 22 and backing plates 27. An electric field forms between the static charge on plates 22 and 27 and thus surrounds central plates 22. When the voltage gradient of this electrical field is sufficiently large, the air ionizes, there is a corona discharge and ozone is produced. Normally, a minimal electric current of 1 milliamp passes through mica sheeting 24. Fuse 36 preferably has a 1 amp capacity. Ozone is a powerful oxidizing agent and useful for eliminating odors. Additionally, the charge on plates 22 and 27 attracts airborne impurity particles to plates 22, 26 and 27. As a result, air passing through air purifier 10 is electrostatically filtered and purged of odors.

To clean air purifier 10, voltage source 35 is disconnected and housing top 28 is removed, thereby exposing grid assembly 18. Cleaning instruments such as brushes can be readily inserted between parallel central plates 22 to clean central plate side surfaces 32 and inside and outside backing plates 26 and 27. Cleaning solutions may also be easily applied and wiped across and along the grid plates. Any impurity particles attracted to plates 22, 26 and 27 can be removed and typically dropped through openings in housing bottom 29. If desired, housing bottom 29 can also be removed.

Various modifications and variations will no doubt occur to those skilled in the various arts to which this invention pertains. For example, the particular connection of the central electrode plates to each other and the housing may be varied from that disclosed herein. These and all other variations which basically rely on the teachings through which this disclosure has advanced the art are properly considered within the scope of this invention.

The embodiments of the invention in which an exclosure property or privilege is claimed are defined as follows.

1. An air purifying apparatus comprising:

a conductive central plate having a substantially planar side and edge surfaces and a planar end surface, said end surface being substantially perpendicular to both said side and edge surfaces for carrying an electrical charge of a first polarity capable of attracting airborne particle impurities;

a substantially planar dielectric layer having a first surface butting against and contacting said planar end surface and generally perpendicular to said side and edge surfaces of said central plate;

a substantially planar conductive backing plate oriented in a plane parallel to said dielectric layer, perpendicular to said side and edge surfaces of said central plate, and butting against and engaging a second side of said dielectric layer, which second dielectric layer side is opposite to the side contacted by said central plate, said backing plate carrying an electric charge of a second polarity which is opposite from said first polarity and capable of attracting airborne particle impurities whereby an electric field is created between said central plate and said backing plate for producing ozone adjacent said end surface of said central plate where that end surface butts against said first surface of said dielectric layer; and means for applying an electrical voltage to said central plate and backing plate to provide said central plate and backing plate with opposite polarity electrical charges, respectively, and an electrical field between said plates.

2. An air purifying apparatus as recited in claim 1 further comprising:

said means for applying an electric voltage to said central plate and backing plate including a transformer having a first output of a first polarity, a second output of a second polarity, said first polarity being opposite from said second polarity and an input adapted to be coupled to a power source;

a substantially parallel, spaced, first plurality of said central plates coupled to said first output for carrying an electric charge of said first polarity, said central plates having side and edge surfaces parallel to other such side surfaces and substantially planar end surfaces, said end surfaces being oriented substantially perpendicular to said side and edge surfaces and oriented along a first common plane with other such end surfaces;

said substantially planar first dielectric layer being oriented along said first common plane and butting against said end surfaces; and said substantially planar conductive backing plate being oriented parallel to said first common plane, butting against said first dielectric layer on said second side of said first dielectric layer, and coupled to said second output for carrying an electric charge of said second polarity, thereby creating an electric field of sufficient voltage gradient between said central plates and said first backing plate to produce ozone adjacent said central plates and to attract airborne particle impurities to said central plates and said first backing plate.

3. An air purifying apparatus comprising:

a conductive central plate having a substantially planar side surface and a planar end surface, said end surface being substantially perpendicular to said side surface, for carrying an electrical charge of a first polarity capable of attracting airborne particle impurities;

a substantially planar dielectric layer having a first surface butting against said end surface and generally perpendicular to said side surface of said central plate;

a substantially planar conductive backing plate oriented in a plane parallel to said dielectic layer and butting against a second side of said dielectric layer opposite to said central plate, for carrying an electric charge of a second polarity, opposite from said first polarity and capable of attracting airborne particle impurities, thereby creating an electric field between said central plate and said backing plate for producing ozone adjacent said central plate; and means for applying an electrical voltage to said central plate and backing plate to provide said central plate and backing plate with opposite polarity electrical charges, respectively, and an electrical field between said plates;

said means for applying an electrical voltage to said central plate and backing plate including a transformer having a first output of a first polarity, a second output of a second polarity, said first polarity being opposite from said second polarity and an input adapted to be coupled to a power source;

a substantially parallel, spaced, first plurality of said central plates coupled to said first output for carrying an electric charge of said first polarity, said central plates having side surfaces parallel to other such side surfaces and substantially planar end surfaces, said end surfaces being oriented substantially perpendicular to said side surfaces and oriented along a first common plane with other such end surfaces;

said substantially planar first dielectric layer being oriented along said first common plane and abutting against said end surfaces;

said substantially planar conductive backing plate being oriented parallel to said first common plane, butting against said first dielectric layer on said second side of said first dielectric layer, and coupled to said second output for carrying an electric charge of said second polarity, thereby creating an electric field of sufficient voltage gradient between said central plates and said first backing plate to produce ozone adjacent said central plates and to attract airborne particle impurities to said central plates and said first backing plate;

a substantially parallel, spaced, second plurality of said conductive central plates coupled to said first output for carrying a charge of said first polarity, said second plurality of central plates having a first extremity coupled to said first plurality of central plates and a second extremity including end surfaces of said second plurality of central plates which are oriented along a second common plane being parallel to and spaced from said first common plane;

a substantially planar second dielectric layer oriented along said second common plane and butting against said end surfaces of said second plurality of central plates; and a second substantially planar conductive plate oriented parallel to said second common plane, butting against said second dielectric layer on the opposite side of said second dielectric layer from said central plates, and coupled to said second output for carrying a charge of said second polarity and thereby creating an electric field of sufficient voltage gradient between said central plates and said second backing plate to produce ozone adjacent said central plates and to attract airborne particle impurities to said central plates and said second backing plate.

4. An air purifying apparatus as recited in claim 3 further comprising:

a connecting means for coupling said first backing plate to said second backing plate and applying a compressing force to said central plates and said dielectric layers intermediate said first and second backing plates.

5. An air purifier apparatus as recited in claim 4 further comprising:

an elongated conductive central core pin passing through said first plurality and said second plurality of central plates for coupling together and supporting said first and second pluralities of central plates; and a plurality of spacers mounted on and along said central core pin, said spacers being located between adjacent central plates.

6. An air purifying apparatus as recited in claim 5 further comprising:

a housing surrounding said central plates having a top air access opening and a bottom air access opening whereby air can flow between said top and bottom openings in a predetermined direction, the planes of said central plates being positioned generally parallel to said predetermined direction such that air flow between said top and bottom air access openings is parallel to said side surfaces of said central plates and said first and second common planes.

7. An air purifying apparatus as recited in claim 6 further comprising:

a potentiomter coupled to said input of said transformer for varying the voltage applied to said transformer by said power source.

8. An air purifying apparatus as recited in claim 5 wherein said transformer has a turns ratio of about 1 to 44, said central plates, said central core pin, said spacers and said backing plates are stainless steel, said dielectric layer is mica.

9. An air purifying apparatus comprising:

a transformer having a first output of a first polarity, a second output of a second polarity, said first polarity being opposite from said second polarity and an input adapted to be coupled to a power source;

a substantially parallel, spaced first plurality of conductive stainless steel central plates coupled to said first output for carrying an electric charge of said first polarity, said central plates having side surfaces parallel to other such side surfaces and substantially planar end surfaces, said end surfaces being oriented substantially perpendicular to said side surfaces and oriented along a first common plane with other such end surfaces;

a substantially planar first dielectric mica layer oriented along said first common plane and butting against said end surfaces;

a first substantially planar conductive stainless steel backing plate oriented parallel to said first common plane, butting against said first dielectric layer on the opposite side of said first dielectric layer from said end surfaces, and coupled to said second output for carrying an electric charge of said second polarity, thereby creating an electric field of sufficient voltage gradient between said central plates and said first backing plate to produce ozone adjacent said central plates and to attract airborne particle impurities to said central plates and said first backing plate;

a substantially parallel, spaced second plurality of conductive stainless steel central plates coupled to said first output for carrying a charge of said first polarity, said second plurality of central plates having a first extremity coupled to said first plurality of central plates and a second extremity including said end surfaces of said second plurality of central plates oriented along a second common plane, said second common plane being parallel to and spaced from said first common plane;

a substantially planar second dielectric mica layer oriented along said second common plane and butting against said end surfaces of said second plurality of central plates;

a second, substantially planar, conductive, stainless steel backing plate oriented parallel to said second common plane, butting against said second dielectric layer from said central plates, and coupled to said second output for carrying a charge of said second polarity and thereby creating an electric field of sufficient voltage gradient between said central plates and said second backing plate to produce ozone adjacent said central plates and to attract airborne particle impurities to said central plates and said second backing plate;

a connecting means for coupling said first backing plate to said second backing plate and applying a compressing force to said central plates and said dielectric layers intermediate said first and second backing plates;

an elongated conductive stainless steel central core pin passing through said first plurality and said second plurality of central plates for coupling together and supporting said first and second pluralities of central plates;

a plurality of stainless steel spacers mounted on and along said central core pin, said spacers being located between adjacent central plates, so only one of said central plates from said first plurality and only one of said central plates from said second plurality are located between adjacent spacers;

a housing surrounding said central plates having a top air access opening and a bottom air access opening whereby air can flow between said top and bottom openings in a predetermined direction, the planes of said central plates being positioned generally parallel to said predetermined direction such that air flow between said top and bottom air access openings is parallel to said side surfaces of said central plates and said first and second common planes; and a potentiometer coupled to said input of said transformer for varying the voltage applied to said transformer by said power source.

10. Air purifying apparatus for electrostatically precipitating airborne impurity particles and for eliminating odors comprising a grid assembly and means for connecting said assembly to a source of electrical power, said assembly including a pair of spaced, electrically conductive first plate means for carrying an electrical charge of a first polarity; central, electrically conductive, planar, plate means intermediate of and extending between said first plate means for carrying an electrical charge of a second polarity opposite said first polarity, said central plate means including end surfaces generally parallel to and adjacent to each of said respective first plate means and generally perpendicular to the other surfaces of said central plate means, dielectric means interposed between each of said first plate means and said respective end surfaces of said central plate means to prevent direct electrical contact therebetween; and means for securing said first plate means and central plate means whereby said dielectric means are held firmly therebetween and in engagement with said first plate means and central plate means.

11. The air purifying apparatus of claim 10 including a plurality of said central plate means on each being spaced from one to another for ease in cleaning particle impurities therefrom.

12. The air purifying apparatus of claim 10 wherein said means for securing said first plate means and central plate means include at least one electrically conductive connecting means extending between said first plate means out of contact with said central plate means.

13. The air purifying apparatus of claim 10 wherein said means for securing said first plate means and central plate means include means for clamping said first plate means toward one another and firmly sandwiching said dielectric means between an engagement with said first plate means and central plate means.

* * * * *

UNITED STATES PATENT AND TRADEMARK OFFICE

CERTIFICATE OF CORRECTION

PATENT NO. : 4,049,400

DATED : September 20, 1977

INVENTOR(S) : R. Jackson Bennett et al

It is certified that error appears in the above-identified patent and that said Letters Patent are hereby corrected as shown below:

Column 1, Line 35

"or" should be --of--.

Column 1, Line 54

"with the" should be --with an--.

Column 2, Line 67

".004°-.005" should be --.004-005--.

Column 3, Line 3

"about" should be --abut--.

Column 3, Line 49

"1/2" " should be --1/4"--.

Column 4, Line 17

"housng" should be --housing--.

Column 4, Line 18

"amodized" should be --anodized--.

Column 4, Lines 61-62

"exclosure" should be --exclusive--.

UNITED STATES PATENT AND TRADEMARK OFFICE

CERTIFICATE OF CORRECTION

PATENT NO. : 4,049,400

DATED : September 20, 1977

INVENTOR(S) : R. Jackson Bennett et al

It is certified that error appears in the above-identified patent and that said Letters Patent are hereby corrected as shown below:

Column 5, Line 29

"electric" should be --electrical--.

Column 6, Line 4

"dielectic" should be --dielectric--.

Column 7, Line 11

"purifier" should be --purifying--.

Column 7, Line 34

"potentiomter" should be --potentiometer--.

Column 9, Line 14

"means on each" should be --means each--.

Column 10, Line 12

"an engagement" should be --and in engagement--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*